US010196227B2

(12) United States Patent
Maeda

(10) Patent No.: US 10,196,227 B2
(45) Date of Patent: Feb. 5, 2019

(54) SHEET FOLDING DEVICE

(71) Applicant: RISO KAGAKU CORPORATION, Tokyo (JP)

(72) Inventor: Kunihiro Maeda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 524 days.

(21) Appl. No.: 14/546,557

(22) Filed: Nov. 18, 2014

(65) Prior Publication Data

US 2015/0141230 A1 May 21, 2015

(30) Foreign Application Priority Data

Nov. 19, 2013 (JP) ..... 2013-238490

(51) Int. Cl.
*B31B 1/26* (2006.01)
*B31B 1/36* (2006.01)
*B65H 45/14* (2006.01)

(52) U.S. Cl.
CPC ..... *B65H 45/147* (2013.01); *B65H 2601/10* (2013.01)

(58) Field of Classification Search
CPC .. B31F 1/00; B31F 1/10; B31F 1/0006; B31F 5/022; B31F 2201/0715; B65H 5/062; B65H 45/18; Y10T 83/2196
USPC ..... 493/395, 397, 402, 405, 419, 320, 424, 493/427, 442
See application file for complete search history.

(56) References Cited

U.S. PATENT DOCUMENTS 4,158,456 A * 6/1979 Holland-Letz ..... B65H 3/44 271/118
4,316,606 A * 2/1982 Buys ..... B65H 3/5261 271/10.04
5,186,448 A * 2/1993 Ohsawa ..... B65H 3/0669 271/10.09
6,857,996 B2 * 2/2005 Dorer ..... B65H 45/144 270/32
8,187,158 B2 * 5/2012 Vallonthaiel ..... B65H 45/142 493/419
2002/0086786 A1 * 7/2002 Kamizuru ..... B31F 1/00 493/405

(Continued)

FOREIGN PATENT DOCUMENTS

JP 2001-072256 3/2001
JP 2002-193544 7/2002
JP 2003-073028 3/2003

OTHER PUBLICATIONS

Official Action, Japanese Patent Application No. 2013-238490, dated May 23, 2017 (1 page).

*Primary Examiner* — Andrew M Tecco
*Assistant Examiner* — Eyamindae Jallow
(74) *Attorney, Agent, or Firm* — Hamre, Schumann, Mueller & Larson, P.C.

(57) ABSTRACT

A sheet folding device includes first and second folding rollers as a pair arranged on a sheet transfer path located downstream of a printing unit and configured to form a fold on a printed sheet. At least the first folding roller includes a small-diameter portion formed at a position corresponding to a range of a width of a separating roller in the sheet width direction, and a large-diameter portion formed at a position other than the position of the small-diameter portion.

10 Claims, 5 Drawing Sheets

(56) References Cited

U.S. PATENT DOCUMENTS

2003/0022780 A1* 1/2003 Ifkovits ..... B43M 5/04
493/419

* cited by examiner

SHEET FOLDING DEVICE

CROSS REFERENCE TO RELATED APPLICATION

This application is based upon and claims the benefit of priority from the prior Japanese Patent Application No. 2013-238490, filed on Nov. 19, 2013, the entire contents of which are incorporated herein by reference.

BACKGROUND

1. Technical Field

This disclosure relates to a sheet folding device configured to perform a folding process on a printed paper sheet (hereinafter, simply referred to as "sheet") printed in a printing unit in an image forming device, by using a pair of folding rollers arranged on a sheet transfer path downstream of the printing unit.

2. Related Art

In Japanese Patent Application Publication No. 2002-193544, a sheet folding device equipped with a sheet folding technique is used in a case of making a sealed letter or the like by folding a printed sheet which is printed in a printing unit in an image forming device.

In the above sheet folding device, though illustration is omitted here, a printed sheet which is printed in an image forming unit in the image forming device is transferred into a Z-folding process unit, for example.

In this Z-folding process unit, first to third folding rollers are each provided with three large-diameter portions at a sheet transfer center portion and sheet transfer end portions, and a small-diameter portion is provided between the sheet transfer center portion and each sheet transfer end portion.

A Z-folding process is performed by transferring a printed sheet between the first to third folding rollers with the sheet brought into contact with only the large-diameter portions provided at the sheet transfer center portions of the first to third folding rollers while both end sides of the sheet are left out of contact with the first to third folding rollers.

In this way, the area of contact of the sheet with the first to third folding rollers is reduced, thus making it possible to ensure paths to relieve sheet folding pressure on the sheet upon application of the pressure. Accordingly, formation of creases on the sheet is prevented.

SUMMARY

Here, in the above sheet folding device, in the Z-folding process of a printed sheet with the first to third folding rollers, only the center portion of the sheet is brought into contact with the large-diameter portions of the pairs of folding rollers, and both end portions of the sheet are out of contact with the pairs of folding rollers. Thus, although no difference in speed occurs between the center portion of the sheet and both end portions of the sheet, both end sides of the sheet do not receive the folding pressure and are therefore folded only loosely.

Meanwhile, in general image forming devices, sheets loaded on a paper feed tray are fed one by one between a separating roller and a separating member arranged at a position corresponding to center portions of the sheets in the sheet width direction perpendicular to the sheet transfer direction, and are transferred into a printing unit, and an ink image is printed on the sheet by using an ink in the printing unit. One surface of each sheet that comes into contact with the separating roller in the above process is set to be a print surface on which to print an ink image.

Here, when the one surface of a sheet comes into contact with the separating roller, paper dust is produced by the friction. If an ink image is printed with this paper dust adhering to the center portion of the one surface in the sheet width direction, the ink mixes with the paper dust adhering to the center portion of the one surface in the sheet width direction, thereby making the sheet considerably dirty.

Moreover, if the printed sheet printed in the printing unit in the image forming device undergoes a folding process with at least one pair of folding rollers arranged on a sheet transfer path downstream of the printing unit, the dirt adhering to the center portion of the one surface of the sheet in the sheet width direction is transferred onto a center portion of the pair of folding rollers in the sheet width direction.

Consequently, the dirt transferred onto the center portion of the pair of folding rollers in the sheet width direction accumulates, thus increasing the diameter of the center portion of the pair of folding rollers in the sheet width direction. As a result, the circumferential speed of the center portion of the pair of folding rollers in the sheet width direction becomes faster than that of both end portions of the pair of folding rollers.

Thus, in the case of the above image forming devices, the roller circumferential speed of the center portion of the pair of folding rollers in the sheet width direction is faster than that of both end portions of the pair of folding rollers, thereby forming creases on the center portion of the sheet in the sheet width direction, unlike the device in Japanese Patent Application Publication No. 2002-193544 in which only the center portion of a sheet is brought into contact with the large-diameter portions of the pairs of folding rollers and both end portions of the sheet are out of contact with the pairs of folding rollers.

An object of the present invention is to provide a sheet folding device capable of: preventing loose folding of both end sides of a printed sheet when performing a folding process on the sheet with a pair of folding rollers arranged on a sheet transfer path downstream of a printing unit, after the sheet is transferred into the printing unit and an ink image is printed on the sheet in the printing unit, the sheet being one of sheets loaded on a paper feed tray and fed one by one between a separating roller and a separating member arranged along the sheet width direction; and even if dirt as a mixture of an ink and paper dust produced by the separating roller in an image forming device adheres to the print surface of the printed sheet, preventing the dirt from being transferred onto the pair of folding rollers at a position corresponding to the range of the width of the separating roller.

A sheet folding device in accordance with some embodiments is for separating sheets loaded on a paper feed tray one by one between a separating roller and a separating member arranged along a sheet width direction of the sheet, transferring the sheet into a printing unit, printing an ink image on the sheet in the printing unit, and then performing a folding process on the printed sheet. The sheet folding device includes first and second folding rollers as a pair arranged on a sheet transfer path located downstream of the printing unit and configured to form a fold on the printed sheet. At least the first folding roller includes a small-diameter portion formed at a position corresponding to a range of a width of the separating roller in the sheet width direction, and a large-diameter portion formed at a position other than the position of the small-diameter portion.

According to the above configuration, even if dirt as a mixture of an ink and paper dust produced by the separating roller adheres to the print surface of a printed sheet, the dirt will not be transferred onto the small-diameter portion of at least one folding roller (first folding roller) in the pair of folding rollers formed at the position corresponding to the range of the width of the separating roller. This prevents increase in the roller diameter of the small-diameter portion due to accumulation of the dirt, and thereby prevents any speed difference in the sheet width direction for the pair of folding rollers. Accordingly, creases will not be formed on the sheet.

A width of the small-diameter portion of the first folding roller may be greater than the width of the separating roller.

According to the above configuration, the small-diameter portion of at least one folding roller (first folding roller) in the pair of folding rollers is formed slightly wider than the width of the separating roller, for example. This prevents loose folding of both end sides of the sheet in the width direction. Accordingly, the folding process can be done well along the sheet width direction.

Upon one surface of the sheet that comes into contact with the separating roller being a print surface, the first folding roller may be arranged on a side on which the first folding roller comes into contact with the print surface.

According to the above configuration, in the case where one surface of the sheet that comes into contact with the separating roller is a print surface, at least one folding roller (first folding roller) in the pair of folding rollers is arranged on such a side as to come into contact with the print surface. This prevents transfer of dirt onto the small-diameter portion of at least one folding roller in the pair of folding rollers. Accordingly, the above configuration is effective in suppressing the formation of creases on the sheet.

DETAILED DESCRIPTION

Figure 1:
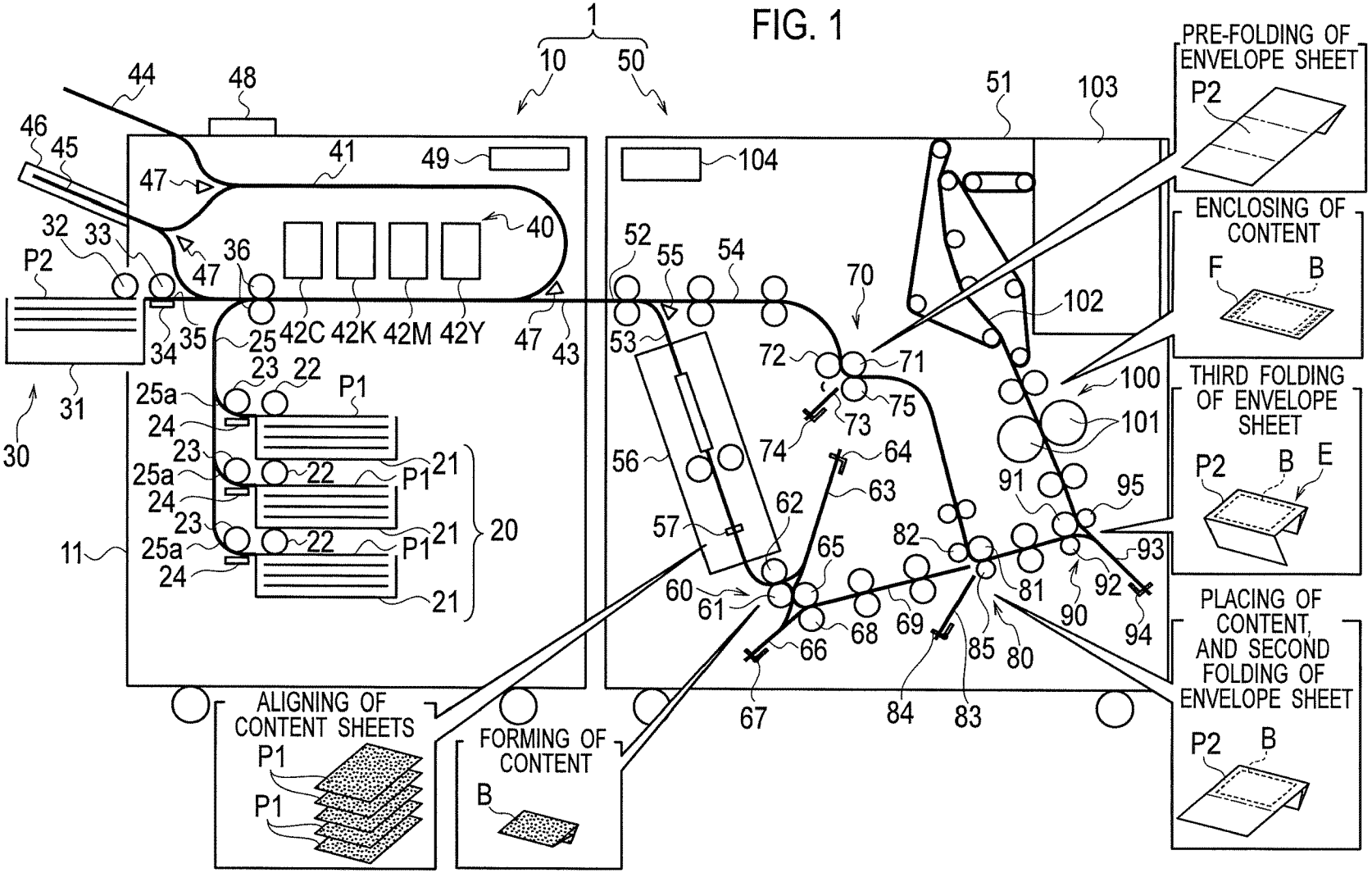
FIG. 1 is a view of the configuration of a sealed letter making system employing a sheet folding device according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Hereinbelow, a sheet folding device according to one embodiment of the present invention will be described in detail with reference to FIGS. 1 to 6. In drawings, a sheet transfer direction and a sheet width direction are denoted by STD and SWD, respectively. Moreover, in drawings, a print surface (ink image surface) is denoted by PS, and dirt is denoted by DT.

The sheet folding device according to this embodiment is configured to perform a folding process on a printed sheet with a pair(s) of folding rollers arranged on a sheet transfer path downstream of a printing unit, after the sheet is transferred into the printing unit and an ink image is printed on the sheet in the printing unit, the sheet being one of sheets loaded on a paper feed tray and fed one by one between a separating roller and a separating member arranged along the sheet width direction.

Here, before describing the sheet folding device according to this embodiment, a sealed letter making system employing the sheet folding device will be described with reference to FIG. 1 and FIGS. 2A and 2B.

FIG. 1 illustrates a sealed letter making system employing the sheet folding device according to this embodiment. Also, FIGS. 2A and 2B each illustrate a state where dirt as a mixture of inks and paper dust produced by a first or second separating roller adheres to a center portion of an ink image on a content sheet or envelope sheet when the sheet is printed in an image forming device illustrated in FIG. 1.

As illustrated in FIG. 1, a sealed letter making system 1 includes: an image forming device 10 configured to perform inkjet printing on a content sheet P1 and an envelope sheet P2; and a sealed letter making device 50 configured to make a sealed letter F by folding the printed content sheet P1 delivered from the image forming device 10 to form a content B, folding the printed envelope sheet P2 into an envelope shape, and then enclosing the content B into an envelope E thus folded.

Image Forming Device

In the image forming device 10, a first paper feeding unit 20 is arranged in a lower section of a first casing 11, and a second paper feeding unit 30 is arranged in a left section of the first casing 11.

In the first paper feeding unit 20, multiple first paper feed trays 21 on which content sheets P1 are loaded are provided next to each other vertically.

A first paper feeding roller 22 is provided over the uppermost one of the content sheets P1 loaded on each first paper feed tray 21. Moreover, a narrow first separating roller 23 and a first separating member 24 facing each other vertically are provided downstream of each first paper feeding roller 22 in the sheet transfer direction.

Each content sheet P1 has a long length in the sheet transfer direction and a short width in the sheet width direction which is perpendicular to the sheet transfer direction.

The first paper feeding roller 22 and the first separating roller 23 share an unillustrated drive source and are rotatably provided at a position corresponding to a center portion of the content sheet P1 in the width direction. Also, their widths W1 in the sheet width direction (FIGS. 2A and 2B) are set to a narrow width.

After the first paper feeding roller 22 feeds content sheets P1 loaded on the first paper feed tray 21, the first separating roller 23 and the first separating member 24 sandwich the fed content sheets P1 and separate them by using frictional force. As a result, only the uppermost content sheet P1 is selectively delivered to a branched path 25*a* of a first fed sheet transfer path 25.

Here, when content sheets P1 are fed one by one between the first separating roller 23 and the first separating member 24, paper dust is produced by the friction on the center portion, in the sheet width direction, of one surface of the content sheet P1 that comes into contact with the first separating roller 23. The content sheet P1 in this state is delivered to a later-described printing unit 40 with the one surface as a print surface.

A second paper feed tray 31 on which envelope sheets P2 are loaded is arranged in the second paper feeding unit 30.

A second paper feeding roller 32 is provided over the uppermost one of the envelope sheets P2 loaded on the second paper feed tray 31. Moreover, a narrow second separating roller 33 and a second separating member 34 facing each other vertically are provided downstream of the second paper feeding roller 32 in the sheet transfer direction.

Each envelope sheet P2 has a long length in the sheet transfer direction and a width which is short but greater than the width of the content sheets P1 in the sheet width direction perpendicular to the sheet transfer direction.

The second paper feeding roller 32 and the second separating roller 33 share an unillustrated drive source and are rotatably provided at a position corresponding to a center portion of the envelope sheet P2 in the width direction. Also, their widths W1 in the sheet width direction (FIGS. 2A and 2B) are set to a narrow width.

After the second paper feeding roller 32 feeds envelope sheets P2 loaded on the second paper feed tray 31, the second separating roller 33 and the second separating member 34 sandwich the fed envelope sheets P2 and separate them by using frictional force. As a result, only the uppermost envelope sheet P2 is delivered to a second fed sheet transfer path 35.

Here, when envelope sheets P2 are fed one by one between the second separating roller 33 and the second separating member 34, paper dust is produced by the friction on the center portion, in the sheet width direction, of one surface of the envelope sheet P2 that comes into contact with the second separating roller 33. The envelope sheet P2 in this state is delivered to the later-described printing unit 40 with the one surface as a print surface.

The downstream ends of the first and second fed sheet transfer paths 25, 35 join together immediately before a pair of registration rollers 36.

The content sheet P1 delivered to the first fed sheet transfer path 25 and the envelope sheet P2 delivered to the second fed sheet transfer path 35 each strike the pair of registration rollers 36 which are not rotated, thereby forming a loop. With this loop, the position of the leading end of the sheet P1, P2 is aligned at the pair of registration rollers 36. The pair of registration rollers 36 are rotated after an elapse of a predetermined period of time. In this way, the skew of the sheet P1, P2 is corrected at the pair of registration rollers 36, and the sheet P1, P2 is delivered to the printing unit 40.

The printing unit 40 is arranged in an upper section of the first casing 11 and has a print transfer path 41 formed in a looped shape so that the content sheet P1 and the envelope sheet P2 can be printed on both sides.

In a lower side of the looped print transfer path 41, multiple line-type inkjet heads 42C, 42K, 42M, 42Y are arranged for ink colors of cyan (C), black (K), magenta (M), and yellow (Y), respectively, in this order from an upstream side toward a downstream side in the sheet transfer direction.

The multiple line-type inkjet heads 42C, 42K, 42M, 42Y print ink images of their colors on the one surface of each of the content sheet P1 and the envelope sheet P2.

Here, a connection transfer path 43 branching off from the looped print transfer path 41 is formed on the right side of the first casing 11. Thus, the content sheet P1 and the envelope sheet P2 after the printing are delivered through the connection transfer path 43 to the later-described sealed letter making device 50.

Figure 2A:
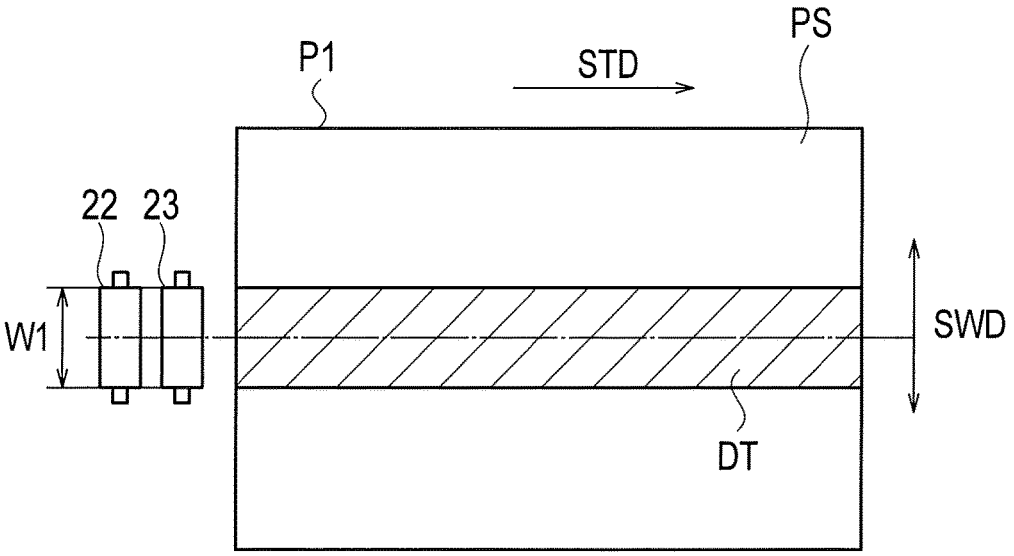
FIG. 2A is a view illustrating a state where dirt as a mixture of inks and paper dust produced by a first separating roller adheres to a center portion of an ink image on a content sheet when the content sheet is printed in an image forming device illustrated in FIG. 1.
Figure 2B:
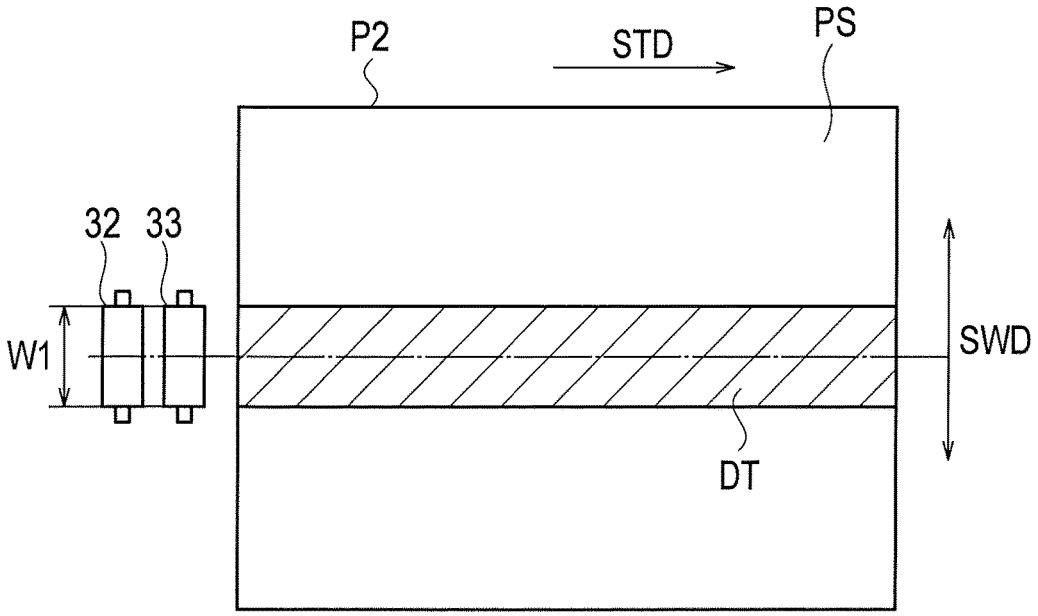
FIG. 2B is a view illustrating a state where dirt as a mixture of inks and paper dust produced by a second separating roller adheres to a center portion of an ink image on a content sheet when the content sheet is printed in an image forming device illustrated in FIG. 1.

Here, when ink images are printed on the content sheet P1 and the envelope sheet P2 in the image forming device 10, the paper dust produced as mentioned earlier by the first and second separating rollers 23, 33, which are narrow in the sheet width direction, adheres to the center portions of the ink image surfaces of the content sheet P1 and the envelope sheet P2 in the sheet width direction, as illustrated in FIGS. 2A and 2B. This paper dust adhering to the center portions mixes with the inks and turns into dirt. The sheets P1, P2 are delivered to the sealed letter making device 50 with this dirt adhering thereto along the sheet transfer direction in regions covering the widths of the first and second separating rollers 23, 33.

Referring back to FIG. 1, a sheet discharge transfer path 44 for discharging sheets branching off from the looped print transfer path 41 is formed on an upper left side of the first casing 11.

A switchback transfer path 45 for double-sided printing included in the looped print transfer path 41 extends into a case 46 provided on the left side of the first casing 11, and then joins the downstream ends of the first and second fed sheet transfer paths 25, 35.

Here, flappers 47 are provided for the branching points and the switchback transfer path 45 branching from the looped print transfer path 41, such that the transfer path can be switched.

An operation panel 48 is provided on the upper surface of the first casing 11. A first controlling unit 49 configured to control the first and second paper feeding units 20, 30, the printing unit 40, and unillustrated sheet transfer means is arranged inside the first casing 11.

Sealed Letter Making Device

In the sealed letter making device 50, a connection transfer path 52 connected to the connection transfer path 43 of the image forming device 10 is provided in a left section of a second casing 51. The downstream end of the connection transfer path 52 is branched off into a content sheet transfer path 53 and an envelope sheet transfer path 54.

A flapper 55 provided at the branching point between the content sheet transfer path 53 and the envelope sheet transfer path 54 operates such that the path can be switched selectively between these two sheet transfer paths 53, 54.

In a case where a printed content sheet P1 is delivered from the image forming device 10 into the sealed letter making device 50, the printed content sheet P1 is delivered through the connection transfer path 52 to the content sheet transfer path 53 via the flapper 55. Multiple content sheets P1 are collected and aligned in an aligning unit 56 provided on the content sheet transfer path 53.

Thereafter, the multiple printed content sheets P1 aligned in the aligning unit 56 are passed through a gate 57 provided in the aligning unit 56 in such a way as to be openable and closable, and then delivered to a content sheet folding unit 60 near the downstream end of the aligning unit 56.

Then, in the content sheet folding unit 60, the multiple printed content sheets P1 are tri-folded to form a content B, and this content B is delivered to a later-described second envelope sheet folding unit 80 through a content transfer path 69.

The content sheet folding unit 60 is one example of the sheet folding device according to this embodiment, which will be described later in detail.

In a case where a printed envelope sheet P2 is delivered from the image forming device 10 into the sealed letter making device 50, the printed envelope sheet P2 is delivered through the connection transfer path 52 to the envelope sheet transfer path 54 via the flapper 55.

First, second, and third envelope sheet folding units 70, 80, 90 are arranged in the envelope sheet transfer path 54 in this order from an upstream side toward a downstream side in the sheet transfer direction.

The printed envelope sheet P2 undergoes pre-folding as first folding in the first envelope sheet folding unit 70.

Then, the printed envelope sheet P2 undergoes second folding in the second envelope sheet folding unit 80 and, at the same time, the content B delivered through the content transfer path 69 is enclosed therein.

Thereafter, the printed envelope sheet P2 undergoes third folding in the third envelope sheet folding unit 90 to thereby form an envelope E, and this envelope E is delivered to a later-described sealing unit 100.

The first, second, and third envelope sheet folding units 70, 80, 90 are other examples of the sheet folding device according to this embodiment, which will also be described later in detail.

The sealing unit 100 is arranged at the most downstream point in the envelope sheet transfer path 54. In the sealing unit 100, one of end portions of the envelope sheet P2 with a folding portion overlapping compression bonding glue previously adhered to the end portion is pressed by a pair of sealing rollers 101 provided in the sealing unit 100. As a result, the envelope E is sealed, so that a sealed letter F with the content B enclosed therein is formed. Note that the sealing unit 100 may apply glue, instead of using the compression bonding glue.

Thereafter, the sealed letter F sealed in the sealing unit 100 is transferred through a sealed letter transfer path 102 and stored in a sealed letter storing unit 103.

In the second casing 51, a second controlling unit 104 is arranged which is configured to control the first, second, and third envelope sheet folding units 70, 80, 90, the sealing unit 100, and unillustrated sheet transfer means.

Sheet Folding Device According to this Embodiment

Next, the sheet folding device according to this embodiment will be described with reference to FIG. 1 used in the previous section and also with new FIGS. 3 to 6.

Figure 3:
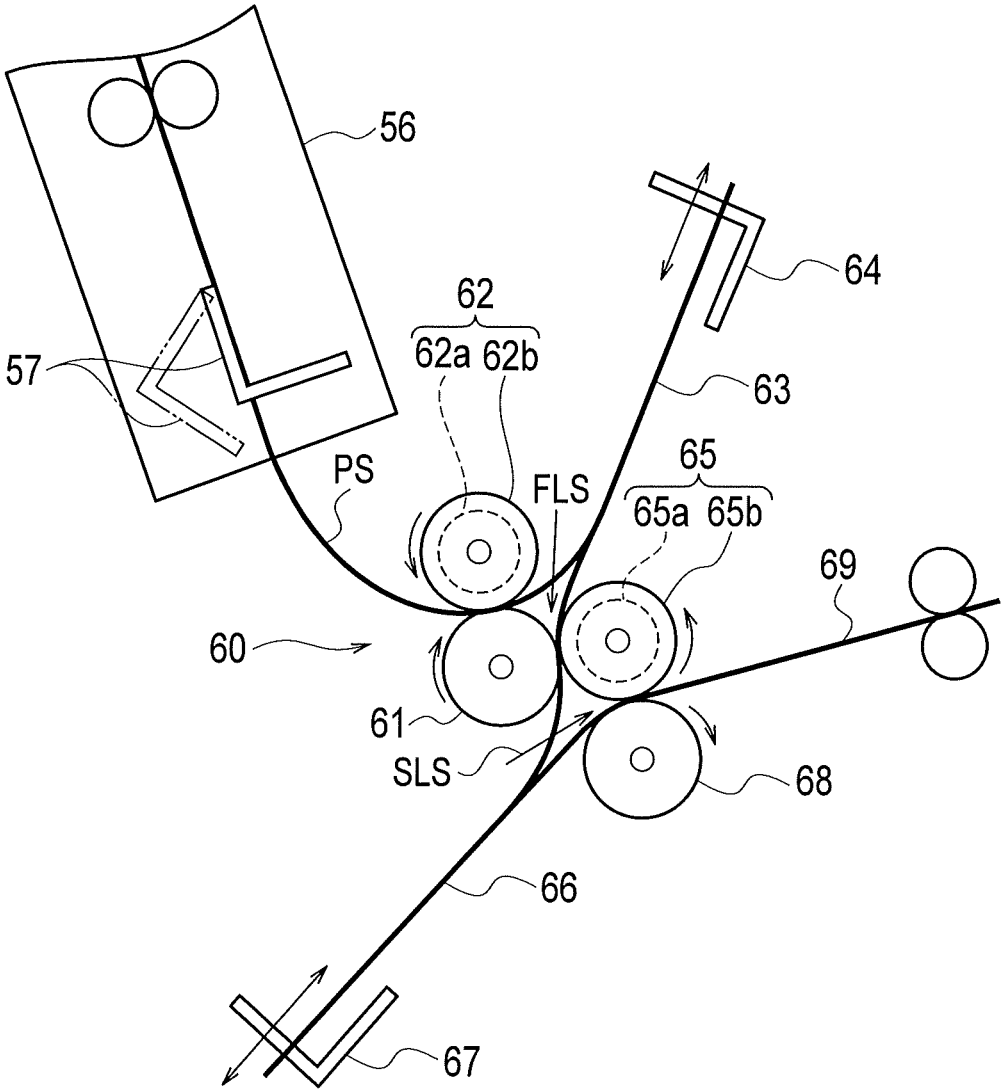
FIG. 3 is an enlarged view illustrating one example of the sheet folding device (content sheet folding unit) illustrated in FIG. 1.
Figure 4:
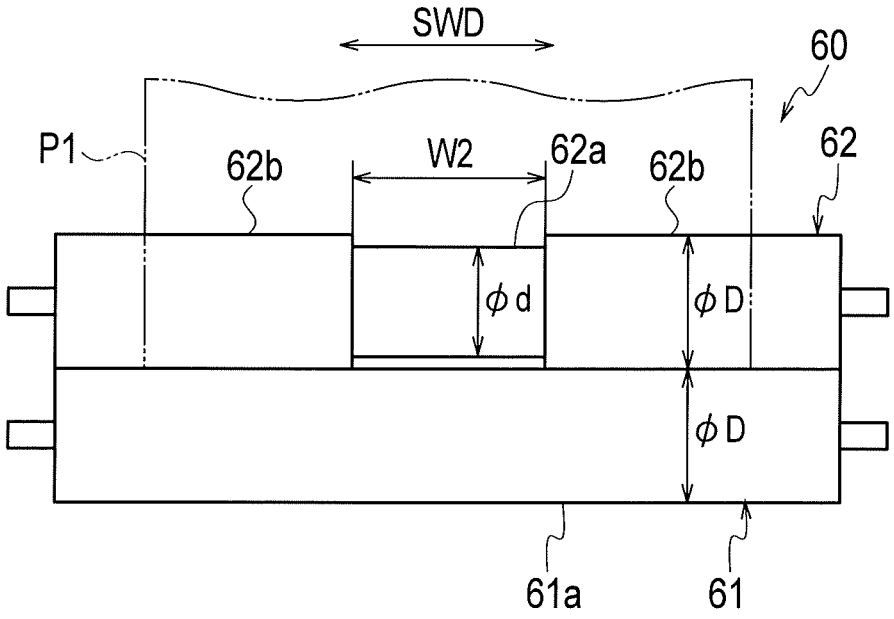
FIG. 4 is an enlarged view illustrating a pair of folding rollers in the one example of the sheet folding device (content sheet folding unit) illustrated in FIG. 3.

FIG. 3 is an enlarged view of one example of the sheet folding device (content sheet folding unit) according to this embodiment illustrated in FIG. 1. Moreover, FIG. 4 is an enlarged view of a pair of folding rollers in the one example of the sheet folding device (content sheet folding unit) illustrated in FIG. 3.

Figure 5:
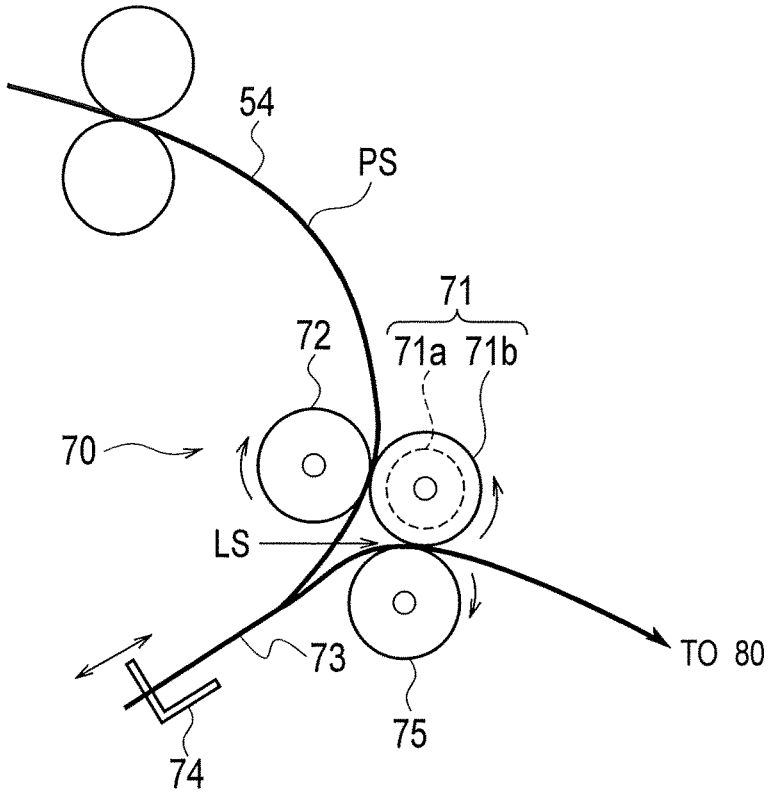
FIG. 5 is an enlarged view illustrating another example of the sheet folding device (envelope sheet folding unit) illustrated in FIG. 1.
Figure 6:
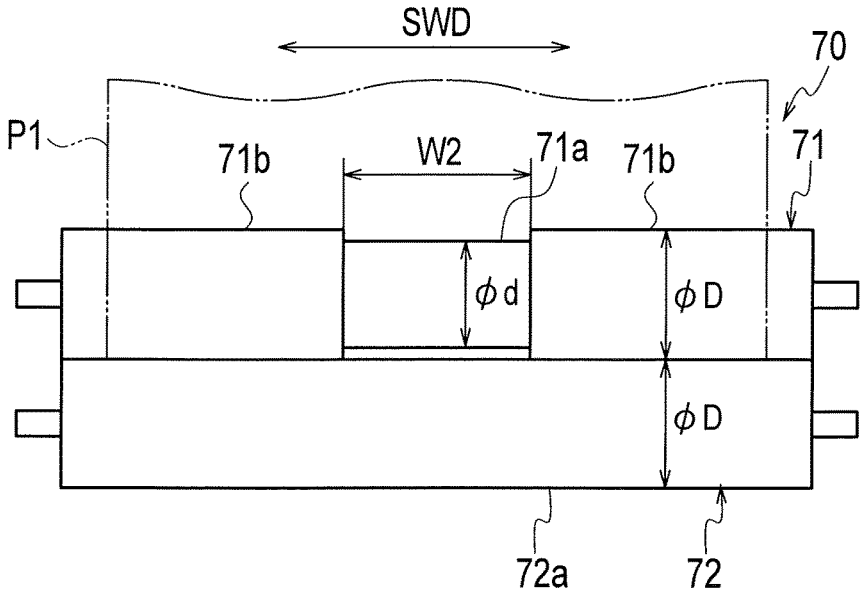
FIG. 6 is an enlarged view illustrating a pair of folding rollers in the other example of the sheet folding device (envelope sheet folding unit) illustrated in FIG. 5.

Further, FIG. 5 is an enlarged view of another example of the sheet folding device (envelope sheet folding unit) illustrated in FIG. 1. Furthermore, FIG. 6 is an enlarged view of a pair of folding rollers in the other example of the sheet folding device (envelope sheet folding unit) illustrated in FIG. 5.

First, as illustrated in the enlarged view in FIG. 3, in the one example of the sheet folding device (content sheet folding unit) 60, a main-folding roller 61 and a first sub-folding roller 62 are provided facing each other respectively on a lower side and an upper side of the content sheet transfer path 53 near the downstream end of the aligning unit 56 provided in the sealed letter making device 50. The main-folding roller 61 is configured to be rotationally driven clockwise by an unillustrated drive source. The first sub-folding roller 62 forms a pair with the main-folding roller 61 and is configured to be rotated counterclockwise.

A first guide plate 63 and a first striking member 64 capable of moving along the first guide plate 63 for positional adjustment are provided downstream of the main-folding roller 61 and the first sub-folding roller 62.

A second sub-folding roller 65 which forms a pair with the main-folding roller 61 and is configured to be rotated counterclockwise is provided on a right side with respect to the first guide plate 63. A second guide plate 66 is provided downstream of the main-folding roller 61 and the second sub-folding roller 65. A second striking member 67 capable of moving along the second guide plate 66 for positional adjustment is provided.

A third sub-folding roller 68 configured to rotate clockwise by following the second sub-folding roller 65 is provided on a right side with respect to the second guide plate 66.

In the case where the sheet folding device (content sheet folding unit) 60 is configured as described above, multiple printed content sheets P1 having passed through the gate 57 provided in the aligning unit 56 in such a way as to be openable and closable are fed between main-folding roller 61 and the first sub-folding roller 62, and the leading end portions of these content sheets P1 move along the first guide plate 63 and strike the first striking member 64. Consequently, the leading end portions of the content sheets P1 stop.

Then, as the multiple printed content sheets P1 are fed further by the main-folding roller 61 and the first sub-folding roller 62, a first loosening FLS is formed at a middle portion of each content sheet P1. This first loosened portion is pulled into the space between the main-folding roller 61 and the second sub-folding roller 65, so that a first fold is formed.

Thereafter, the first folded portion moves along the second guide plate 66 and strikes the second striking member 67 and thereby stops. Here, as the main-folding roller 61 and the second sub-folding roller 65 further rotate, a second loosening SLS is formed at a middle portion of each content sheet P1 having finished the first folding.

Further, the second loosened portion is pulled into the space between the second sub-folding roller 65 and the third sub-folding roller 68, thereby forming a second fold, so that a tri-folded content B is obtained. This content B is transferred toward to the content transfer path 69.

Meanwhile, as described above, when ink images are printed on the one surface of a content sheet P1 in the image forming device 10, the inks mix with the paper dust produced by the first separating roller 23, which is narrow in the sheet width direction, so that the center portion, in the sheet width direction, of the ink image surface, or the one surface of the content sheet P1 becomes considerably dirty. The printed content sheet P1 in such a state is delivered into the sealed letter making device 50.

Here, when such content sheets P1 with the dirt on the center portions of their one surfaces in the sheet width direction undergo the folding process in the sheet folding device (content sheet folding unit) 60, transferring the dirt onto a center portion of at least one pair of folding rollers in the sheet width direction will result in increase in the roller diameter of the center portion, thereby causing a difference in speed between the center portion and both end portions of the pair of folding rollers in the sheet width direction, as mentioned earlier. Consequently, creases are formed on the content sheets P1.

In view of this, in this embodiment, to suppress the formation of creases mentioned above, at least one folding roller (first sub-folding roller) 62 in the pair of folding rollers 61, 62 which are the main-folding roller 61 and the first sub-folding roller 62 in the sheet folding device (content sheet folding unit) 60 is designed such that a small-diameter portion 62*a* slightly wider than the width of the first separating roller 23 is formed at the center portion in the sheet width direction perpendicular to the sheet transfer direction, while large-diameter portions 62*b* are formed at both sides of the small-diameter portion 62*a* along the sheet width direction.

The portion of the other folding roller (main-folding roller) 61 between both ends is formed to be the same in diameter as the large-diameter portions 62*b* of the one folding roller 62.

Even if the dirt as a mixture of the inks and the paper dust produced by the first separating roller 23 adheres to the center portion of the print surface of the printed content sheet P1, such dirt will not be transferred or accumulated on the small-diameter portion 62*a* of at least one folding roller 62 in the pair of folding rollers 61, 62 formed at the center portion in the sheet width direction corresponding to the range of the width of the first separating roller 23. This prevents increase in the roller diameter of the small-diameter portion 62*a* and therefore prevents any difference in speed between the center portion and both end portions of the pair of folding rollers 61, 62 in the sheet width direction. Thus, no creases are formed on the content sheet P1.

Moreover, since the small-diameter portion 62*a* of at least one folding roller 62 in the pair of folding rollers 61, 62 is formed slightly wider than the width of the first separating roller 23, it is possible to prevent loose folding of both end sides of the content sheet P1 in the width direction. Accordingly, the folding process can be done well along the sheet width direction.

More specifically, as illustrated in the enlarged views in FIGS. 3 and 4, the main-folding roller 61 in the pair of folding rollers 61, 62 in the sheet folding device (content sheet folding unit) 60 is such that a long large-diameter portion 61*a* with a diameter ϕD is formed along the sheet width direction of the content sheet P1.

On the other hand, the first sub-folding roller 62 in the pair of folding rollers 61, 62 is such that a small-diameter portion 62*a* with a diameter ϕd and a width W2 slightly larger than the width W1 (FIGS. 2A and 2B) of the first separating roller 23 (e.g. W2 is about W1 mm+5 to 10 mm) is formed at the center portion in the sheet width direction of the content sheet P1, whereas a large-diameter portion 62*b* with the diameter ϕD greater than the diameter ϕd is formed at both sides of the small-diameter portion 62*a* along the sheet width direction.

Here, as illustrated earlier in FIG. 2A, the ink image surface, or the one surface, of the content sheet P1 that comes into contact with the first separating roller 23 becomes considerably dirty. Thus, by forming the small-diameter portion 62*a* at the center portion of the first sub-folding roller 62 that comes into contact with this ink image surface, the dirt will not be transferred onto the small-diameter portion 62*a* of the first sub-folding roller 62. This is effective in suppressing the formation of creases on the content sheet P1.

Referring back to FIG. 3, similarly to the above, a small-diameter portion 65*a* slightly wider than the width of the first separating roller 23 is formed at the center portion of the second sub-folding roller 65 in the pair of folding rollers 61, 65 which are the main-folding roller 61 and the second sub-folding roller 65, and large-diameter portions 65*b* are formed at both sides of the small-diameter portion 65*a* along the sheet width direction.

In this way, the formation of creases on the content sheet P1 can be suppressed also for the pair of rollers 61, 65 and the pair of rollers 65, 68.

Next, of the other examples of the sheet folding device (first, second, and third envelope sheet folding units) 70, 80, 90, the first envelope sheet folding unit 70 configured to perform the first folding process on the envelope sheet P2 includes a main-folding roller 71 and a first sub-folding roller 72 which are provided on an upstream side of the envelope sheet transfer path 54 provided in the sealed letter making device 50, in such a way as to face each other respectively on a right side and a left side of the envelope sheet transfer path 54, as illustrated in the enlarged view in FIG. 5. The main-folding roller 71 is configured to be rotationally driven counterclockwise by an unillustrated drive source. The first sub-folding roller 72 forms a pair with the main-folding roller 71 and is configured to be rotated clockwise.

A guide plate 73 is provided downstream of the main-folding roller 71 and the first sub-folding roller 72. A striking member 74 capable of moving along the guide plate 73 for positional adjustment is provided.

A second sub-folding roller 75 which forms a pair with the main-folding roller 71 and is configured to be rotated clockwise is provided on a right side with respect to the guide plate 73.

In the case where the sheet folding device (first envelope sheet folding unit) 70 is configured as described above, a printed envelope sheet P2 delivered to the envelope sheet transfer path 54 is fed between the main-folding roller 71 and the first sub-folding roller 72. Then, the leading end portion of this envelope sheet P2 moves along the guide plate 73 and strikes the striking member 74. Consequently, the leading end portion of the envelope sheet P2 stops.

Then, as the printed envelope sheet P2 is fed further by the main-folding roller 71 and the first sub-folding roller 72, a loosening LS is formed at a middle portion of the envelope sheet P2. This loosened portion is pulled into the space between the main-folding roller 71 and the second sub-folding roller 75, so that a pre-fold is formed as a first fold. Thereafter, the envelope sheet P2 is transferred to the second envelope sheet folding unit 80.

In this case, too, as described above, when ink images are printed on the one surface of an envelope sheet P2 in the image forming device 10, the inks mix with the paper dust produced by the second separating roller 33, which is narrow in the sheet width direction, so that the center portion, in the sheet width direction, of the ink image surface, or the one surface of the envelope sheet P2 becomes considerably dirty. The printed envelope sheet P2 in such a state is delivered into the sealed letter making device 50.

Here, when the envelope sheet P2 with the dirt on the center portion of the one surface in the sheet width direction undergoes the folding process in the sheet folding device (first envelope sheet folding unit) 70, transferring the dirt onto a center portion of at least one pair of folding rollers in the sheet width direction will result in increase in the roller diameter of the center portion, thereby causing a difference in speed between the center portion and both end portions of the pair of folding rollers in the sheet width direction, as mentioned earlier. Consequently, creases are formed on the envelope sheet P2.

In view of this, in this embodiment, to suppress the formation of creases mentioned above, at least one folding roller (main-folding roller) 71 in the pair of folding rollers 71, 72 which are the main-folding roller 71 and the first sub-folding roller 72 in the sheet folding device (envelope sheet folding unit) 70 is designed such that a small-diameter portion 71*a* slightly wider than the width of the second separating roller 33 is formed at the center portion in the sheet width direction perpendicular to the sheet transfer direction, while large-diameter portions 71*b* are formed at both sides of the small-diameter portion 71*a* along the sheet width direction.

The portion of the other folding roller (first sub-folding roller) 72 between both ends is formed to be the same in diameter as the large-diameter portions 71*b* of the one folding roller 71.

Even if the dirt as a mixture of the inks and the paper dust produced by the second separating roller 33 adheres to the center portion of the print surface of the printed envelope sheet P2, such dirt will not be transferred or accumulated on the small-diameter portion 71*a* of at least one folding roller 71 in the pair of folding rollers 71, 72 formed at the center portion in the sheet width direction at a position corresponding to the range of the width of the second separating roller 33. This prevents increase in the roller diameter of the small-diameter portion 71*a* and therefore prevents any difference in speed between the center portion and both end portions of the pair of folding rollers 71, 72 in the sheet width direction. Thus, no creases are formed on the envelope sheet P2.

Since the small-diameter portion 71*a* of at least one folding roller 71 in the pair of folding rollers 71, 72 is formed slightly wider than the width of the second separating roller 33, it is possible to prevent loose folding of both end sides of the envelope sheet P2 in the width direction. Accordingly, the folding process can be done well along the sheet width direction.

More specifically, as illustrated in the enlarged views in FIGS. 5 and 6, the main-folding roller 71 in the pair of folding rollers 71, 72 in the sheet folding device (envelope sheet folding unit) 70 is such that a small-diameter portion 71*a* with the diameter ϕd and the width W2 slightly greater than the width W1 (FIGS. 2A and 2B) of the second separating roller 33 (e.g. W2 is about W1 mm+5 to 10 mm) is formed at the center portion in the sheet width direction of the envelope sheet P2, whereas a large-diameter portion 71*b* with the diameter ϕD greater than the diameter ϕd is formed at both sides of the small-diameter portion 71*a* along the sheet width direction.

On the other hand, the first sub-folding roller 72 in the pair of folding rollers 71, 72 is such that a long large-diameter portion 71*a* with the diameter ϕD is formed along the sheet width direction of the envelope sheet P2.

Here, as illustrated earlier in FIG. 2B, the ink image surface, or the one surface, of the envelope sheet P2 that comes into contact with the second separating roller 33 becomes considerably dirty. Thus, by forming the small-diameter portion 71*a* at the center portion of the main-folding roller 71 that comes into contact with this ink image surface, the dirt will not be transferred onto the small-diameter portion 71*a* of the main-folding roller 71. This is effective in suppressing the formation of creases on the envelope sheet P2.

Referring back to FIG. 5, similarly to the above, the second sub-folding roller 75 in the pair of folding rollers 71, 75 which are the main-folding roller 71 and the second sub-folding roller 75 may be such that a large-diameter portion is formed between both ends, or a small-diameter portion is formed at a center portion and large-diameter portions are formed at both sides thereof.

Moreover, as illustrated in FIG. 1, as in the case of the first envelope sheet folding unit 70 described above, the second envelope sheet folding unit 80 configured to perform the second folding process on the envelope sheet P2 is provided with: a main-folding roller 81 configured to be rotationally driven by an unillustrated drive source; a first sub-folding roller 82 forming a pair with the main-folding roller 81 and configured to be rotated; a guide plate 83 downstream of the main-folding roller 81 and the first sub-folding roller 82; a striking member 84 capable of moving along the guide plate 83 for positional adjustment; and a second sub-folding roller 85 configured to rotate by following the main-folding roller 81.

In the second envelope sheet folding unit 80, too, at least one folding roller in the pair of folding rollers 81, 82 and the pair of folding rollers 81, 85 is designed such that a small-diameter portion slightly wider than the width of the second separating roller 33 is formed at a center portion in the sheet width direction perpendicular to the sheet transfer direction, while large-diameter portions are formed at both sides of the small-diameter portion along the sheet width direction. In this way, the formation of creases on the envelope sheet P2 is suppressed.

As in the case of the first and second envelope sheet folding units 70, 80 described above, the third envelope sheet folding unit 90 configured to perform the third folding process on the envelope sheet P2 is, too, provided with: a main-folding roller 91 configured to be rotationally driven by an unillustrated drive source; a first sub-folding roller 92 forming a pair with the main-folding roller 91 and configured to be rotated; a guide plate 93 downstream of the main-folding roller 91 and the first sub-folding roller 92; a striking member 94 capable of moving along the guide plate 93 for positional adjustment; and a second sub-folding roller 95 configured to rotate by following the main-folding roller 91.

In the third envelope sheet folding unit 90, too, at least one folding roller in the pair of folding rollers 91, 92 and the pair of folding rollers 91, 95 is designed such that a small-diameter portion slightly wider than the width of the second separating roller 33 is formed at the center portion in the sheet width direction perpendicular to the sheet transfer direction, while large-diameter portions are formed at both sides of the small-diameter portion along the sheet width direction. In this way, the formation of creases on the envelope sheet P2 from the folding is suppressed.

The sheet folding device (content sheet folding unit) described above in detail is based on the example where, for the folding process of a printed sheet with the pair of folding rollers, a small-diameter portion slightly wider than the width of the separating roller is formed at the center portion, in the sheet width direction, of at least one folding roller in the pair of folding rollers, and large-diameter portions are formed at both sides of the small-diameter portion. However, the present invention is not limited to this example. At least one folding roller in the pair of folding rollers is only required to be configured such that a small-diameter portion is formed at a position corresponding to the range of the width of the separating roller in the sheet width direction, and a large-diameter portion is formed at a position other than the position of the small-diameter portion.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A sheet folding device configured to perform a folding process on a printed sheet received from an image forming device that separates sheets loaded on a paper feed tray one by one between a separating roller and a separating member arranged along a sheet width direction of the sheet, transfers the sheet into a printing unit, and prints an ink image on the sheet in the printing unit, the sheet folding device comprising:

first and second folding rollers as a pair arranged on a sheet transfer path located downstream of the printing unit and configured to form a fold on the printed sheet, wherein at least the first folding roller includes:

a small-diameter portion having a width substantially the same as a width of the separating roller in the sheet width direction, and a large-diameter portion formed at a position other than the position of the small-diameter portion;

wherein the small-diameter portion is located on the first folding roller at a location corresponding to a center of the sheet width, wherein the large-diameter portion has a uniform diameter.

2. The sheet folding device according to claim 1, wherein upon one surface of the sheet that comes into contact with the separating roller being a print surface, the first folding roller is arranged on a side on which the first folding roller comes into contact with the print surface.

3. The sheet folding device according to claim 1, wherein the first folding roller includes a single one of the small-diameter portions.

4. The sheet folding device according to claim 1, wherein the small-diameter portion is formed only at a position corresponding to a range of the width of the separating roller in the sheet width direction.

5. The sheet folding device according to claim 1, wherein the large-diameter portion comprises two large-diameter portions in contact with a portion of the printed sheet other than a portion contacted by the separating roller; and the small-diameter portion is continuously formed between the two large-diameter portions in the sheet width direction and is not in contact with the printed sheet.

6. A sheet folding device configured to perform a folding process on a printed sheet received from an image forming device that separates sheets loaded on a paper feed tray one by one between a separating roller and a separating member arranged along a sheet width direction of the sheet, transfers the sheet into a printing unit, and prints an ink image on the sheet in the printing unit, the sheet folding device comprising:

first and second folding rollers as a pair arranged on a sheet transfer path located downstream of the printing unit and configured to form a fold on the printed sheet, wherein at least the first folding roller includes:

a small-diameter portion having a width substantially the same as a width of the separating roller in the sheet width direction, and a large-diameter portion formed at a position other than the position of the small-diameter portion;

wherein the small-diameter portion is located on the first folding roller at a location corresponding to a center of the sheet width, wherein the small-diameter portion has a uniform diameter.

7. The sheet folding device according to claim 6, wherein upon one surface of the sheet that comes into contact with the separating roller being a print surface, the first folding roller is arranged on a side on which the first folding roller comes into contact with the print surface.

8. The sheet folding device according to claim 6, wherein the first folding roller includes a single one of the small-diameter portions.

9. The sheet folding device according to claim 6, wherein the small-diameter portion is formed only at a position corresponding to a range of the width of the separating roller in the sheet width direction.

10. The sheet folding device according to claim 6, wherein the large-diameter portion comprises two large-diameter portions in contact with a portion of the printed sheet other than a portion contacted by the separating roller; and the small-diameter portion is continuously formed between the two large-diameter portions in the sheet width direction and is not in contact with the printed sheet.

* * * * *